US007289081B2

(12) United States Patent
Mito et al.

(10) Patent No.: US 7,289,081 B2
(45) Date of Patent: Oct. 30, 2007

(54) ANTENNA COIL DEVICE

(75) Inventors: Tomoko Mito, Tokyo (JP); Masaki Saito, Tokyo (JP)

(73) Assignee: Sumida Corporation, Tokyo (JP)

( * ) Notice: Subject to any disclaimer, the term of this patent is extended or adjusted under 35 U.S.C. 154(b) by 47 days.

(21) Appl. No.: 11/409,122

(22) Filed: Apr. 24, 2006

(65) Prior Publication Data

US 2006/0246787 A1 Nov. 2, 2006

(30) Foreign Application Priority Data

Apr. 28, 2005 (JP) ..... 2005-132154

(51) Int. Cl.
*H01Q 13/10* (2006.01)

(52) U.S. Cl. ..... 343/870; 343/872; 343/711; 343/713

(58) Field of Classification Search ..... 343/870, 343/872, 711, 713, 787, 788
See application file for complete search history.

(56) References Cited

U.S. PATENT DOCUMENTS 4,275,400 A * 6/1981 Miyakoshi ..... 343/788
5,959,587 A * 9/1999 McHenry et al. ..... 343/713
7,034,756 B2 * 4/2006 Fujii et al. ..... 343/713

FOREIGN PATENT DOCUMENTS

JP 2005-086402 3/2005

* cited by examiner

*Primary Examiner*—Trinh Dinh
*Assistant Examiner*—Dieu Hien T Duong
(74) *Attorney, Agent, or Firm*—Snider & Associates; Ronald R. Snider

(57) ABSTRACT

In an antenna coil device 100, a coil portion 12 having a lead wire 2 wound around a magnetic core 1 is mounted on a case 3 made of plastic resin, and on one side of the case 3, terminal boards 4 and 5 that electrically connect one end and the other end of the lead wire 2 of the coil portion 12 to an external device are placed in a protruding manner. A latch recess 4D is formed in an inserting end portion 4C of the terminal board 4 to form a tip portion into split shape sites 4E and 4F. A tapered portion 7 is formed on the outside of the split shape sites 4E and 4F, and an end portion of the tapered portion 7 joins an engagement portion 8 that is formed in a protruding manner in the lateral direction of the inserting end portion 4C.

9 Claims, 4 Drawing Sheets

ANTENNA COIL DEVICE

RELATED APPLICATIONS

This application claims the priority of Japanese Patent Application No. 2005-132154 filed on Apr. 28, 2005, which is incorporated herein by reference.

BACKGROUND OF THE INVENTION

1. Field of the Invention

The present invention relates to, for example, an antenna coil device provided on a busbar of defogging heating elements of a rear window glass of a vehicle. More particularly, the present invention relates to an antenna coil device that facilitates easy assembly and the like.

2. Description of the Prior Art

An automobile glass antenna has been known that uses heating elements of a defogger provided in a rear window or an antenna element provided around the heating elements as a receiving antenna for radio broadcast or TV broadcast in order to listen to radio broadcast or view TV broadcast in a vehicle.

In many cases, radio wave signals of radio broadcast or TV broadcast received by such an automobile glass antenna are affected by noise included in the output of a battery for supplying power to the heating elements of the defogger, or by the received radio wave signals leaking to a body or a DC power supply through a feeder that connects the defogging heating elements and a battery.

For this reason, when using an automobile glass antenna, a method is known that inserts a choke coil referred to as an "antenna coil device" between the automobile glass antenna and the body or battery in order to prevent noise being superimposed on the received signal and leakage of signals to the body and the like.

Devices having various kinds of structures have been proposed as this kind of antenna coil device. For example, a device has been proposed that, from a standpoint of securing resistant to vibrations received from the automobile, has a structure in which two relatively thick terminal boards are provided along the longitudinal axial direction of a coil formed in a solenoid form, and which also includes a resin member that holds the two terminal boards and the coil in an integrated condition (for example, see Japanese Unexamined Patent Publication No. 2005-86402).

However, in the device employing a configuration that holds the terminal boards using a resin member as described above, it is necessary that the specific holding structure is one that ensures ease of assembly while, at the same time, reliably holding the terminal boards after assembly.

SUMMARY OF THE INVENTION

The present invention is achieved in view of such circumstances, and an object of the invention is to provide a highly reliable antenna coil device that is easy to assemble and that surely prevents dislodgment of terminal boards after assembly is completed.

The antenna coil device of this invention is an antenna coil device having a coil held by means of a base member comprising an insulator, and two terminal boards that are fixed to the base member and that connect, respectively, to winding ends of the coil, wherein in one of the two terminal boards, one end side to be inserted into the base member is formed so as to be bendable in an orthogonal direction with respect to an insertion direction, and a latch portion that prevents dislodgment of the terminal board in a direction opposite to the insertion direction when the one end side is inserted into the base member is formed in the one end side and the base member.

The one end side of one of the two terminal boards that is to be inserted into the base member is preferably formed in a split shape by providing a latch recess in an opposite direction to the insertion direction from a tip portion thereof.

The latch portion preferably has, at a site that is formed in the split shape, an engagement portion that protrudes in a lateral direction with respect to the insertion direction, and a latch protrusion that is formed in a protruding manner in an interior side wall of an insertion groove of the base member into which the one end side is inserted.

A cross section of the latch recess is preferably formed in a U-shape or a V-shape.

Preferably, on both sides of a terminal board facing the latch recess, a notch is formed that thins the width of the terminal board.

A recess with which the latch protrusion interfits is preferably formed at a site adjoining the engagement portion that is located on an opposite side to a tip side of a site formed in the split shape sandwiching the engagement portion.

Further, at a site formed in the split shape, on an outer edge of a side opposite to the latch recess a tapered portion is formed in a region from a tip thereof to the engagement portion.

Furthermore, a configuration is preferably adopted whereby a width W2 between tip portions of the two engagement portions of one of the two terminal boards is larger than a width W1 of one end side thereof to be inserted into the base member.

BRIEF DESCRIPTION OF THE DRAWINGS

FIG. 1 illustrates schematic views of an antenna coil device according to an embodiment of the present invention, in which

DESCRIPTION OF THE PREFERRED EMBODIMENTS

Hereunder, the antenna coil device according to an embodiment of the present invention is described referring to FIGS. 1 to 4.

Figure 1B:
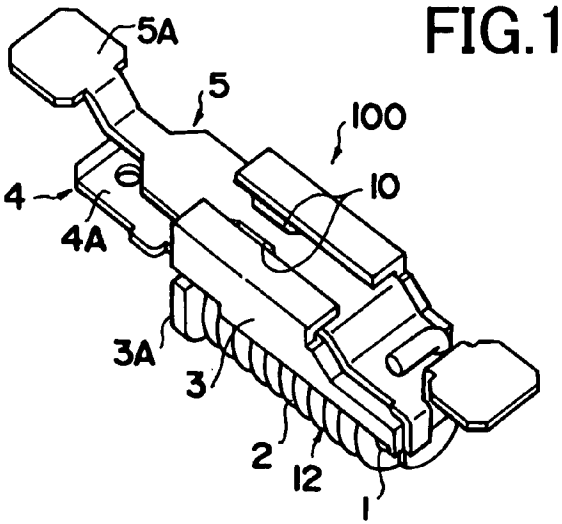
FIG. 1B is a bottom perspective view.
Figure 1A:
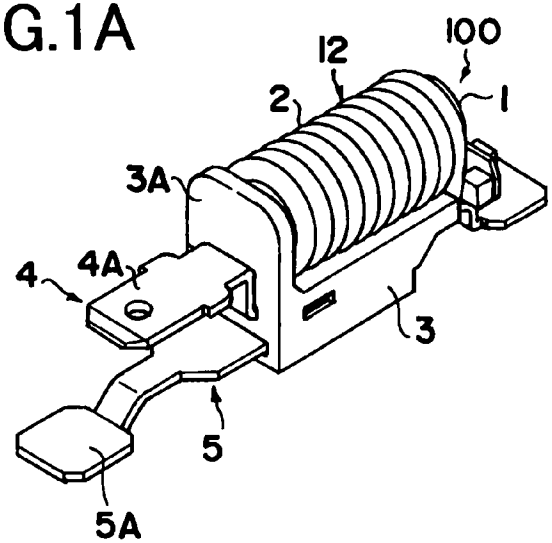
FIG. 1A is a top perspective view.
Figure 1C:
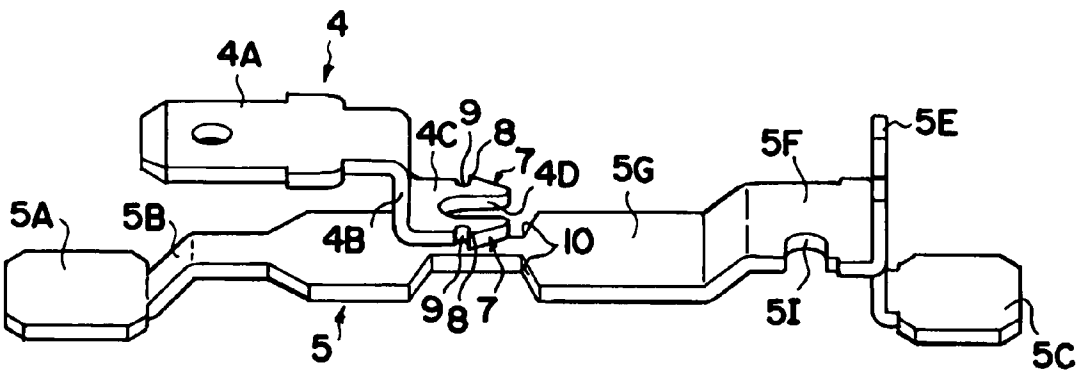
FIG. 1C is a perspective view of terminal boards only.

FIG. 1 shows an antenna coil device 100 according to an embodiment of the present invention, in which FIG. 1A is a top perspective view, FIG. 1B is a bottom perspective view, and FIG. 1C is a perspective view of terminal boards only.

As shown in FIGS. 1A and 1B, in the antenna coil device 100 according to the embodiment of this invention, a coil portion 12 having a lead wire 2 wound around a magnetic core 1 is mounted on a case 3 made of plastic resin as a base member, and on one side (hereinafter referred to as a front side) of the case 3, a terminal board 4 and a terminal board 5 that electrically connect one end and the other end of the lead wire 2 of the coil portion 12 to an external device (not shown), respectively, are placed in a protruding manner. The two terminal boards 4 and 5 can be connected with outer wiring at protruding end portions 4A and 5A provided so as to protrude from the front side of the case 3, and are thus vertically spaced at a predetermined distance.

FIG. 1C schematically shows a placement state of the terminal boards 4 and 5 only. The terminal boards 4 and 5 are formed of metal plates of brass or the like, and actually, a portion of the case 3 is placed between the terminal boards 4 and 5.

As shown, the terminal board 4 is generally formed into a crank shape, and has a rising portion 4B continued to the protruding end portion 4A and placed along a front board 3A of the case 3, and an inserting end portion 4C inserted (press fitted) into the case 3. One end of the lead wire 2 of the coil portion 12 is electrically connected to the inserting end portion 4C seated below the coil portion 12.

On the other hand, the terminal board 5 is long axially of the coil portion 12, and has, at both ends thereof, mounting surfaces 5B and 5C to be joined by soldering onto a busbar provided, for example, on the rear window of a vehicle.

Each end of the terminal board 5 including the mounting surfaces 5B and 5C has a substantial crank shape, and has a rising portion 5E continued to the rear mounting surface 5C and placed along a rear end of the case 3, and a connecting portion 5F of the lead wire 2 placed in the case 3. The other end of the lead wire 2 of the coil portion 12 is inserted into a notch 5I and bent at the connecting portion 5F, and is electrically connected to the terminal board 5.

The terminal board 5 also has a central flat portion 5G that connects the both ends having the substantial crank shape.

As shown in FIG. 1C, the inserting end portion 4C of the terminal board 4 is seated below the coil portion 12, while the central flat portion 5G of the terminal board 5 is placed above the mounting surfaces 5B and 5C so as to be spaced from a surface of the busbar (not shown), and thus the inserting end portion 4C of the terminal board 4 and the central flat portion 5G of the terminal board 5 are placed close to and opposite each other.

Figure 4:
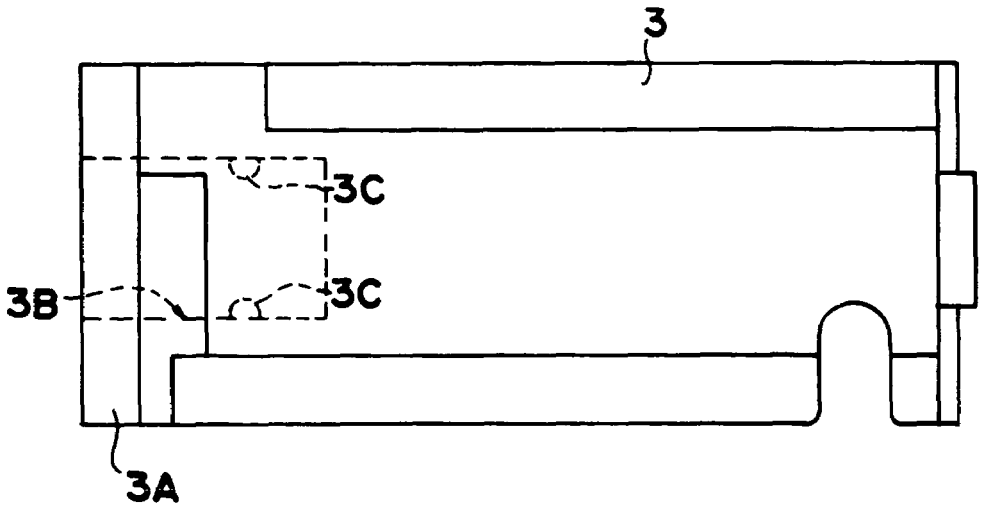
FIG. 4 is a plane view of a case of the antenna coil device according to the embodiment of the present invention.

In the embodiment of this invention, particularly from the viewpoint of ease of assembly and preventing the inserting end portion 4C from dislodging from the case 3, the inserting end portion 4C of the terminal board 4 has a shape as described hereunder, and a latch portion is formed for latching together the inserting end portion 4C of the terminal board 4 and the case 3 (see FIG. 4).

Figure 2:
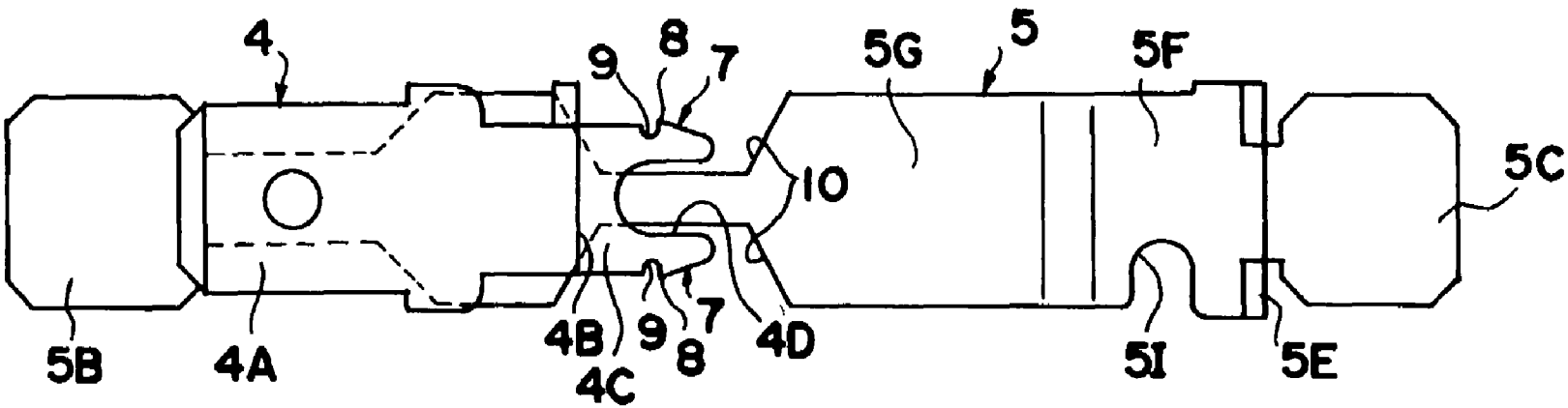
FIG. 2 is a plane view of terminal boards only of the antenna coil device according to the embodiment of the present invention.
Figure 3:
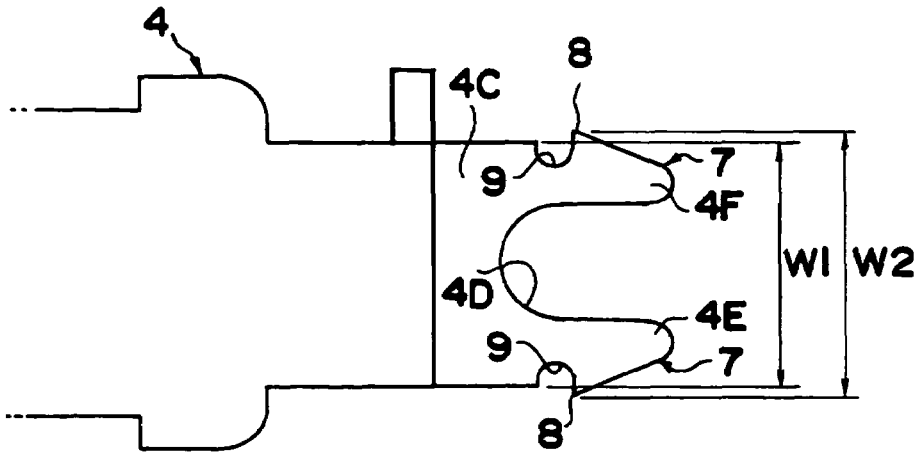
FIG. 3 is an enlarged plane view of a tip portion of one of the terminal boards of the antenna coil device according to the embodiment of the present invention.

Hereunder, a detailed description thereof is provided referring to FIG. 2 to FIG. 4.

First, in the inserting end portion 4C of the terminal board 4, a latch recess 4D is formed at an appropriate length from a tip portion thereof along the insertion direction of the terminal board 4 into the case 3, and the portion in which the latch recess 4D is formed has a split shape. Although the latch recess 4D according to the embodiment of this invention has a substantially U-shape, naturally the latch recess is not limited thereto. For example, a V-shaped groove may also be used.

The insertion direction of the terminal board 4 is the direction from the left side to the right side when FIG. 2 is viewed with the protruding end portion 4A of the terminal board 4 located on the left side and the inserting end portion 4C located on the right side.

As shown in FIG. 3, at two sites 4E and 4F formed in this split shape, at an outer edge portion on the opposite side of the latch recess 4D a tapered portion 7 is formed so as to extend outward in an anti-insertion direction from the tip. The end portion of the tapered portion 7 is joined to an engagement portion 8 formed in a protruding manner in the lateral direction of the inserting end portion 4C.

In an adjoining region of the engagement portion 8 on the opposite side to the tapered portion 7, a recess 9 of a size that is large enough for a latch protrusion 3C of the case 3 to fit therein is formed.

In the embodiment of this invention, when the breadth of the inserting end portion 4C is taken as W1, a width W2 between the tip portions of the engagement portions 8 is designed to be slightly larger than the breadth W1 of the inserting end portion 4C (see FIG. 3).

In this embodiment of the invention, a notch 10 is formed on both sides of one portion of the central flat portion 5G of the terminal board 5 facing the latch recess 4D that is formed in the inserting end portion 4C. The breadth of the terminal board 5 in that portion is thinner than in other regions (see FIG. 2).

Meanwhile, in the case 3 is formed an insertion groove 3B into which the above described inserting end portion 4C is inserted from the front side thereof (see FIG. 4). The insertion groove 3B is formed so that the breadth thereof (the vertical direction on the page surface in FIG. 4) is substantially equal to the breadth W1 of the inserting end portion 4C, and the thickness thereof (the direction from the top surface to rear surface on the page surface in FIG. 4) is substantially equal to the plate thickness of the inserting end portion 4C.

The length of the insertion groove 3B, that is, the length of the inserting end portion 4C in the direction of insertion into the case 3, is substantially equal to the length of the inserting end portion 4C along the longitudinal axial direction of the terminal board 4.

Further, in the interior side wall of the insertion groove 3B a latch protrusion 3C is formed in a protruding manner that latches the engagement portion 8 when the inserting end portion 4C is inserted (see FIG. 4), such that the latch protrusion 3C and the engagement portion 8 constitute a latch portion.

Next, procedures are described for, in particular, inserting the inserting end portion 4C into the case 3 at the time of assembly in the antenna coil device configured as described above.

First, the tip portion of the inserting end portion 4C of the terminal board 4 is disposed at the opening portion of the insertion groove 3B at the front side of the case 3, and a force is applied from the protruding end portion 4A side to push the entire inserting end portion 4C into the insertion groove 3B. Although the tip portion of the inserting end portion 4C enters the insertion groove 3B as a result of the pushing pressure from the protruding end portion 4A side, because of the fact that, according to this embodiment of the invention, the latch recess 4D is formed in the inserting end portion 4C and the tip portion can bend easily toward the inner side in the width direction of the latch recess 4D coupled with the fact that a tapered portion 7 is formed on both sides, the inserting end portion 4C can be inserted to the forward part of the insertion groove 3B with relative ease.

When the inserting end portion 4C proceeds further inside the insertion groove 3B, the engagement portion 8 contacts against the latch protrusion 3C provided inside the insertion groove 3B. Since each of the sites 4E and 4F that are formed in a split shape can bend by a large amount towards the latch recess 4D side in response to that insertion operation, the engagement portion 8 can also pass over the latch protrusion 3C while moving toward the latch recess 4D side to thereby advance further. At a position where the engagement portion 8 has completely passed over the latch protrusion 3C, the latch protrusion 3C fits into the recess 9 of the inserting end portion 4C to thereby complete the insertion of the terminal board 4 into the insertion groove 3B of the case 3.

After insertion of the terminal board 4 is completed, since the engagement portion 8 is latched on the latch protrusion 3C and the latch protrusion 3C is fitted into the recess 9, retention of the terminal board 4 by the case 3 can be realized surely and with a high degree of reliability without the terminal board 4 easily dislodging in the direction opposite to the insertion direction.

Although according to the configuration example described above, the width W1 of the inserting end portion 4C and the width of the insertion groove 3B are made substantially equal, and the width W2 between the tips of the two engagement portions 8 is configured to be slightly larger than the width W1, the configuration is not necessarily limited thereto. More specifically, for example, the width W2 between the tips of the engagement portions 8 and the width of the insertion groove 3B may be made substantially equal, and the width W1 of the inserting end portion 4C may be made slightly smaller than the width W2.

Figure 5:
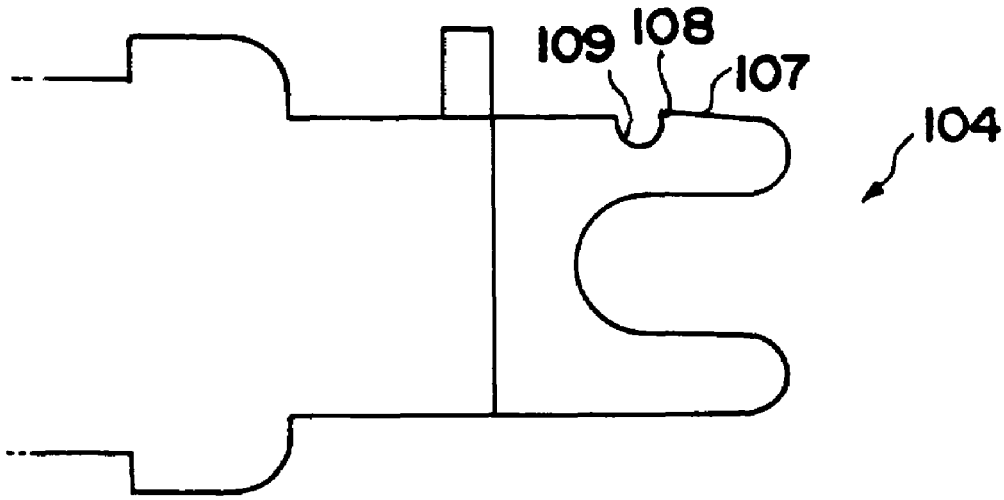
FIG. 5 is a plane view showing a modification of the terminal boards shown in FIG. 2.

Further, although the tapered portion 7 and the engagement portion 8 are formed in each of the two split shape sites 4E and 4F of the inserting end portion 4C, for example, as shown in FIG. 5, a simple configuration may also naturally be adopted whereby a tapered portion 107, an engagement portion 108 and a recess 109 are formed in either one of the regions only. In this case, only one of the latch protrusions 3C needs be provided inside the insertion groove 3B, on the side corresponding to the recess 109. Further, a simpler configuration may be adopted for the inserting end portion 4C by omitting the tapered portion 7.

According to the antenna coil device of the embodiment of this invention, since a notch 10 is formed in a region of the terminal board 5 facing each of the sites 4E and 4F formed in the split shape of the inserting end portion 4C, and the region of the inserting end portion 4C that faces a portion of the central flat portion 5G of the terminal board 5 in which the notch 10 is formed is a latch recess 4D (see FIG. 2), the stray capacitance between the terminal board 4 and the terminal board 5 is reduced in comparison to the conventional device. It is therefore possible to provide a device that has a higher self resonant frequency as an antenna coil device than the conventional device.

As described in the foregoing, according to the antenna coil device of this embodiment, since a configuration is adopted in which one end side of a terminal board to be inserted into a base member is formed so that it can bend in a lateral direction with respect to the insertion direction, an operation to insert the terminal board into the base member is easily performed, enabling assembly work to be carried out with a high degree of efficiency. Further, since a latch portion that latches together a terminal board and the base member is provided to surely fasten the terminal board to the base member, a highly reliable antenna coil device can be provided that surely prevents the terminal board that was inserted into the base member from easily dislodging after assembly.

What is claimed is:

1. An antenna coil device having a coil held by means of a base member comprising an insulator, and two terminal boards that are fixed to the base member and that connect, respectively, to winding ends of the coil, wherein in one of the two terminal boards, one end side to be inserted into the base member is formed so as to be bendable in a lateral direction with respect to an insertion direction, and a latch portion that prevents dislodgment of the terminal board in a direction opposite to the insertion direction when the one end side is inserted into the base member is formed in the one end side and the base member.

2. The antenna coil device according to claim 1, wherein the one end side of one of the two terminal boards that is to be inserted into the base member is formed in a split shape by providing a latch recess in an opposite direction to the insertion direction from a tip portion thereof.

3. The antenna coil device according to claim 2, wherein the latch portion has, at a site that is formed in the split shape, an engagement portion that protrudes in a lateral direction with respect to the insertion direction, and a latch protrusion that is formed in a protruding manner in an interior side wall of an insertion groove of the base member into which the one end side is inserted.

4. The antenna coil device according to claim 3, wherein a recess with which the latch protrusion interfits is formed at a site adjoining the engagement portion that is located on an opposite side to a tip side of a site formed in the split shape sandwiching the engagement portion.

5. The antenna coil device according to claim 4, wherein at a site formed in the split shape, on an outer edge of a side opposite to the latch recess a tapered portion is formed in a region from a tip thereof to the engagement portion.

6. The antenna coil device according to claim 3, wherein at a site formed in the split shape, on an outer edge of a side opposite to the latch recess a tapered portion is formed in a region from a tip thereof to the engagement portion.

7. The antenna coil device according to claim 3, wherein a width W2 between tip portions of the two engagement portions is larger than a width W1 of the one end side of one of the two terminal boards to be inserted into the base member.

8. The antenna coil device according to claim 2, wherein a cross section of the latch recess is formed in a U-shape or a V-shape.

9. The antenna coil device according to claim 2, wherein on both sides of a terminal board facing the latch recess, a notch is formed that thins the width of the terminal board.

* * * * *